United States Patent [19]

Le Coze

[11] 4,186,534

[45] Feb. 5, 1980

[54] PARTITION WALL CAPABLE OF BEING DISMANTLED

[76] Inventor: René-Jean M Le Coze, 10 Rue du Dr. Lettry, 56100 Lorient, France

[21] Appl. No.: 893,689

[22] Filed: Apr. 5, 1978

[30] Foreign Application Priority Data

Apr. 5, 1977 [FR] France ..... 7710274

[51] Int. Cl.[2] ..... E04B 2/74; E04C 1/10

[52] U.S. Cl. ..... 52/241; 52/122; 52/127; 52/595

[58] Field of Search ..... 52/240–242, 52/593, 595, 122, 127

[56] References Cited

U.S. PATENT DOCUMENTS

| | | | |
|---|---|---|---|
| 2,238,355 | 4/1941 | Whitenack | 52/241 X |
| 3,386,216 | 6/1968 | Zwickert | 52/242 X |
| 3,508,364 | 4/1970 | Thompson | 52/242 X |
| 3,511,000 | 5/1970 | Keuls | 52/242 X |
| 4,103,463 | 8/1978 | Dixon | 52/127 X |

FOREIGN PATENT DOCUMENTS

| | | | |
|---|---|---|---|
| 572551 | of 1958 | Italy | 52/240 |

*Primary Examiner*—Karl Bell

*Attorney, Agent, or Firm*—Wenderoth, Lind & Ponack

[57] ABSTRACT

The partition wall comprises a lower horizontal rail provided with a tongue, rectangular panels each having on two adjacent sides tongues and on the opposite sides grooves, the panels being fitted together and mounted on the lower rail. The panels are disposed in superimposed rows in laterally staggered relation. A horizontal upper rail is fitted on the upper row of panels. Clamping devices are carried by the upper rail and bear against a ceiling and thereby press the panels against each other.

8 Claims, 7 Drawing Figures

PARTITION WALL CAPABLE OF BEING DISMANTLED

The utility of partition walls capable of being dismantled is well known. They are indeed extremely frequently employed in business premises, offices, exhibition halls and the like. They may be adapted to be dismantled rapidly or on the contrary conserved as such for several years. Consequently, these partition walls not only must be easy to place in position or dismantle but have sufficient strength.

They are therefore usually composed of elements assembled by means of tongues inserted in grooves of two neighbouring elements, these elements having a considerable height and preferably the height of the partition wall to be installed, which creates handling and positioning problems when erecting or dismantling the partition wall.

It has also been proposed to employ superimposed panels which are interconnected by horizontal tongues and held laterally by vertical posts which support them. Such an arrangement overcomes the difficulties of handling and transporting the panels but considerably complicates the erection since the panels must be raised for the purpose of sliding in their lower part the support means rigid with the vertical uprights.

An object of the present invention is to overcome these drawbacks by providing a partition wall capable of being dismantled and comprising panels of relatively small sizes which may be easily placed in position without the use of special tools and which are clamped together so as to ensure a sufficient strength of the partition wall.

According to the invention, there is provided a partition wall which is capable of being dismantled and comprises a horizontal upper rail, a horizontal lower rail, one of which rails is provided with a tongue and the other with a groove, panels each having on two adjacent sides tongues and on two opposite sides grooves the depth of which grooves corresponds to the outer height of the tongues, said panels being mounted between the rails in superimposed rows which are in laterally staggered relation, and means for clamping the panels against each other and against the lower rail, said clamping means being carried by the outer face of the upper rail and being operative between the upper rail and a ceiling.

Preferably, the partition wall comprises panels of a plurality of sizes so that the edges of the end panels of the different rows may be put in alignment with each other. Further, the partition wall preferably comprises vertical uprights at each of its ends and each of said uprights is provided with a groove whose width corresponds to the width of a panel.

It will be understood that the vertical uprights may be door support posts or uprights for fixing to a support wall.

Such a partition wall is easily placed in position after fixing a vertical upright to the wall and placing the horizontal lower rail on the floor by manually fitting the different panels together, and then placing the upper rail in position. An adjustment of the clamping means between the upper rail and the ceiling is then sufficient to ensure the fixing of the assembly. All these operations can be easily carried out by hand with no special handling or adjustment. Skirting boards or other coverings can be easily secured to the partition wall constructed in this way. Further features and advantages of the invention will be apparent from the ensuring description of an embodiment of the invention given merely by way of example and shown in the accompanying drawings.

Figure 1:
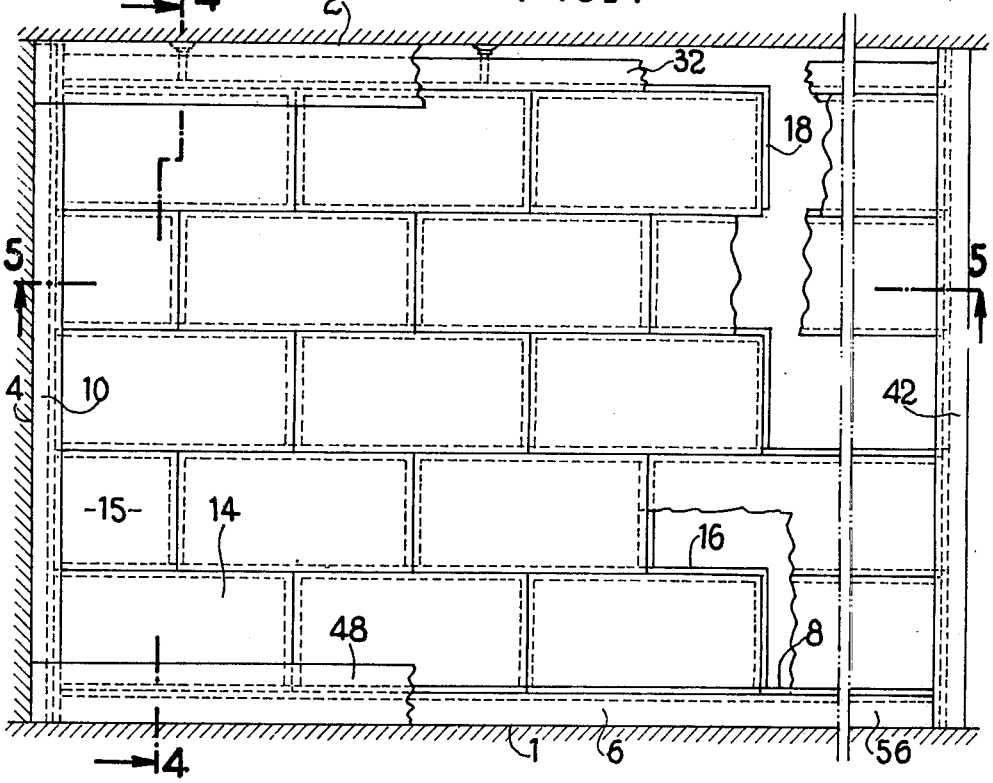
FIG. 1 is a side elevational view with a part cut away of an erected partition wall.

As shown in the drawings, the partition wall according to the invention and capable of being dismantled is mounted between a floor 1 and a ceiling 2 and extends from a support wall 4. This partition wall comprises a horizontal lower rail 6 placed on the floor 1 and provided with a longitudinal tongue 8 in the upper part of the rail. In the vicinity of the support wall this rail 6 is fitted in a groove 12 of a vertical upright or post 10 which is secured by any suitable means, for example by screws and wall-plugs (not shown), to the wall 4. The groove 12 of the upright 10 extends throughout the height of the latter on the side of the upright opposed to the wall 4 and receives alternately superimposed panels 14 and 15 the width of which panels is similar to the width of the rail 6.

Figure 3:
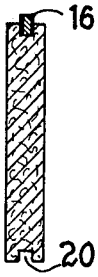
FIG. 3 is a sectional view taken on line 3—3 of FIG. 2.

Each of the panels 14 or 15 which are preferably made of wood or agglomerated lignous materials of the same type, comprises four sides. Two of the adjacent sides which form in the partition wall shown in FIG. 1 the upper edge and the right lateral edge carry a tongue respectively 16 and 18. The two other sides are provided with a groove respectively 20 and 22 the depth of which corresponds to the outer height of the tongue of the opposite sides (FIG. 3). Preferably, the tongue 16, 18 are made from a material which is more compact and stronger than that from which the whole of the panel is made and are maintained in a groove of the panel carrying them by adhesion or any other means.

Figure 6:
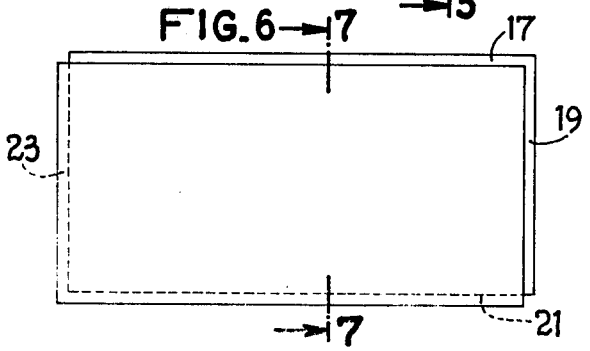
FIG. 6 is a view similar to FIG. 2 of a modification of the panel.
Figure 7:
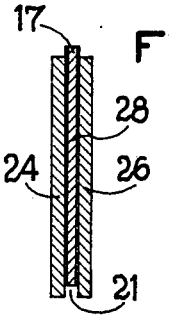
FIG. 7 is a sectional view taken on line 7—7 of FIG. 6.

In a modification shown in FIGS. 6 and 7, the panels are made in a composite manner and comprise two outer plates or slabs 24 and 26 between which there is interposed a more compact plate or slab 28 which is offset relative to the other two plates and thus projects therefrom on two sides of the panel while it is set back therefrom on the other two sides. In this way the plate 28 forms two tongues 17 and 19 and defines two grooves 21 and 23.

Figure 2:
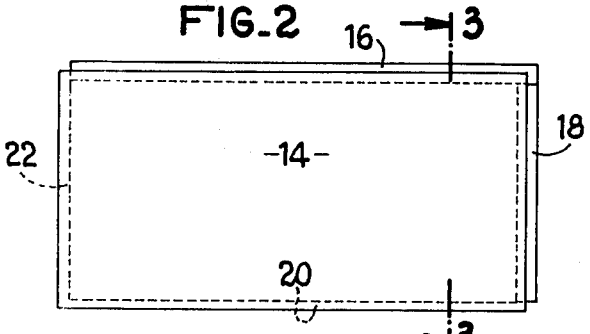
FIG. 2 is a side elevational view of a panel for constructing the partition wall.

The partition wall comprises not only panels 14, such as those shown in FIGS. 2 and 6 which have a rectangular shape, but also substantially square panels 15 the side of which has a length one half of the length of the panel 14. It is in this way possible to dispose panels in superimposed horizontal rows which are laterally staggered or offset relative to each other as shown in FIG. 1, at least one row having one or two panels 15. The panels 14 or 15 are thus superimposed in the manner of bricks, each of the grooves 20 fitting on the tongue 16 or 17 of two lower panels while each of the tongues 18 fit in the groove 22 of the neighbouring panel. In the upper part of the partition wall the tongues 15 of the panels of the last row are fitted in a groove 30 formed in the lower side of a horizontal rail 32.

Figure 4:
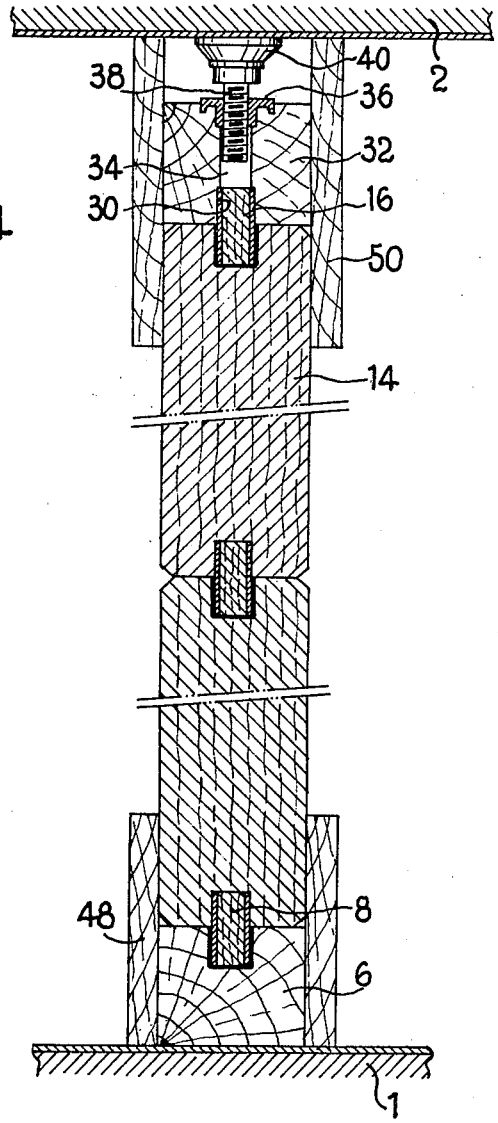
FIG. 4 is a sectional view taken on line 4—4 of FIG. 1.

This upper rail 32 is provided with apertures 34 which are evenly spaced apart and communicate with the upper side of the rail 32 (FIG. 4). A nut 36 is blocked in the end of each of the apertures 34 and a screwthreaded rod 38 is screwthreadedly engaged in this nut. The rod 38 is provided with a flared enlarged head 40 which forms a support surface for bearing against the ceiling 2.

It will be understood that the screwthreaded rod 38 and nut 36 constitute expansible means and that an unscrewing of the rod 38 first applies the head 40 against the ceiling 2 and then tends to move the head 40 and the nut 36 away from each other, that is to say tends to urge the rail 38 against the panels 14 and 15 of the partition wall. As the rods 38 or screw jacks are arranged in equally-spaced relation along the rail 32, their action results in an even compression of the rail 32 against the panels 14 and consequently clamps these panels against each other and against the lower rail 6. The depth of the grooves of each of the panels corresponds to the outer height of the tongues and the panels bear evenly against each other and are rendered closely rigid with each other with no intervention of any binder or like means.

Figure 5:
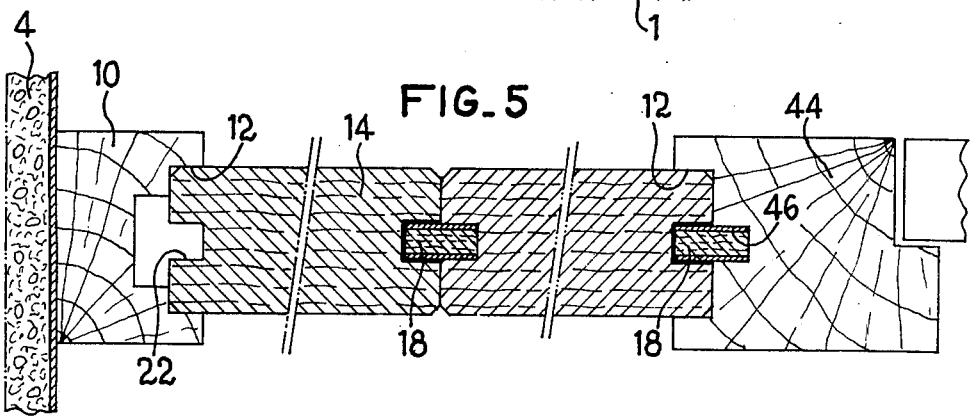
FIG. 5 is a sectional view taken on line 5—5 of FIG. 1.

Preferably a second vertical upright or post similar to the upright 10 is placed at the end of the partition wall opposed to the upright 10. The second upright 42 may be exactly identical to the upright 10 and have a height equal to that of the partition wall. It then forms the end of the partition wall. However, most often the second vertical upright is a support post 44 of a door (FIG. 5). In the same way as the upright 10, the upright 42, 44 comprises a groove 12 whose shape corresponds to that of the end of a panel 14 or 15. This groove 12 is however extended by a smaller groove 46 whose shape corresponds to that of the tongue 18 of the panel assembled therewith. When the upright 44 or 42 does not bear against a wall, it is secured to the floor or ground by screws or any other suitable means.

As shown in FIG. 4, a skirting board 48 and a plinth 50 may be, if desired, mounted on the lower and upper sides of the partition wall so as to embellish the latter and hide the screw jacks 38, 40. Further, whenever desirable, coverings may be placed on the partition wall.

A partition wall of this type is extremely easy to erect. For this purpose, the vertical upright 10 is first secured to the wall 4 in the desired position and then the rail 6 is placed on the floor and fitted in the groove 12 of this upright. Then a first panel 14 or 15 is slid in the groove 12 of the upright 10 and fitted on the tongue 8 of the rail 6. Other panels 14 or 15 are fitted in succession on this tongue 8 and on the tongue 18 of the panel already placed in position. When a first row of panels has thus been laid a second row is placed in position in the same way. However, this second row starts with a panel 15 if the first row started with a panel 14, as clearly shown in FIG. 1. Likewise, the last panel of this row is so chosen that the end edges carrying the tongues 18 or 19 are in vertical alignment with each other. When the highest row of panels has been placed in position, the rail 32 is fitted on the upper tongues of these panels and then the screw jacks are so adjusted as to ensure an appropriate clamping of the panels against each other. A vertical upright 42 or 44 can then be fitted on the end tongues 18 or 19 of the panels of the partition wall. When the vertical upright is a door support post 44, another partition portion must be constructed. This portion may be constructed in the same way as the first portion in starting at a vertical upright 42 secured to a wall opposed to the wall 4 in the lower part of which there is fitted a lower rail 56. Panels 14 and 15 are then fitted on and superimposed on the rail 56 and fitted in the vertical upright 42. When a sufficient height has been reached, a new upright similar to the upright 44 is fitted on the end edge of the panels so as to enable a door to be mounted. A short horizontal rail forms the upper part of the door opening and may support panels which close the space between this door and the ceiling 2.

Irrespective of the embodiment employed, the screw jacks 38 and 40 are adjusted only when all of the panels 14 and 15 have been placed in position.

In any case, all of the operations are carried out by hand since the panels have such dimensions that they are easily handled and transported. Further, no prior precise adjustment or setting is required and no special tool needed. The sole setting required is that of the position of the vertical upright 10 or 42. Any clearance between the ceiling and the panels is immediately compensated for by the screw jacks 38, 40 and the alignment of the panels with each other is achieved automatically when they are fitted together.

The partition wall is also extremely easy to dismantle since the release of the jacks 38, 40 frees the rail 32 and enables the panels 14 or 15 of the upper row to be separated sufficiently to disengage the tongue of these panels. The latter are then easily withdrawn as are all the other panels. As the lower rail is not fixed it can also be easily shifted, the sole fixing means to be withdrawn being those which maintain the vertical uprights 44 and the uprights 10 and 42.

There are then available panels and rails which may be easily transported and re-erected in another place just as rapidly with no need for skilled labour or special tools. Further, the panels may be easily made from agglomerated wood or fibreboard or from any other material light enough to be easily handled but nonetheless imparting sufficient strength to the partition wall. It will be understood that some of the elements of these panels may be sound insulating and/or fireproof so that the partition wall also has qualities providing comfort, attractiveness and safety.

What I claim is:

1. A partition wall structure capable of being dismantled for a room having a floor, ceiling and lateral walls, the partition wall structure comprising in combination an outer framework comprising a horizontal lower rail for placing on the floor, a horizontal upper rail for location adjacent the ceiling and a vertical upright for placing against one of said walls; an assembly in a vertical plane of adjoining generally rectangular panels located within the framework and adjoining the upper rail and the lower rail and adjoining the upright, there being a plurality of the panels in vertically adjoining relation to each other between the upper rail and lower rail and plurality of panels in adjacently adjoining relation to each other, the panels forming therebetween vertical joints which are in laterally staggered relation to each other from one joint to the next higher or lower joint, each panel defining four edges, means defining tongues and grooves which are unitary with the edges of the panel before assembly in said assembly of panels and respectively fitting with corresponding grooves and tongues of adjoining panels in said assembly to interlock the panels perpendicularly of said plane; means interlocking perpendicularly of said plane the upper rail and lower rail with the adjoining panels of said panels and means interlocking perpendicularly of said plane the upright with the adjoining panels of said panels, the upper rail being vertically movable in said framework relative to the upright; the panels being held together to form a wall structure which is coherent and resistant with regard to forces perpendicular to said plane by means consisting of said interlocking tongues and grooves of the panels and of pressure-applying expansible means for applying vertically downward pressure on the upper rail and thereby vertically clamping the panels against one another and against the lower rail, the pressure-applying expansible means being carried by the upper rail for bearing against the ceiling.

2. A partition wall structure as claimed in claim 1, wherein the interlocking means between the vertical upright and the adjoining panels comprise a longitudinal groove in the upright which groove has a width similar to the width of the panels so that the panels fit in the groove.

3. A partition wall/structure as claimed in claim 1 or 2, comprising vertical doorsupporting posts provided with a longitudinal groove having a width similar to the width of the adjoining panels in which groove the adjoining panels are engaged, the groove being extended by a groove corresponding to the shape of a tongue of the panel engaged in the post.

4. A partition wall/structure as claimed in claim 1 or 2, wherein the tongues of the panels are made from a material which is harder than that of the panels and fixed in a groove in the material of the panel itself.

5. A partition wall/structure as claimed in claim 1 or 2, wherein said pressure-applying means comprise screw jacks screwthreadedly engaged in the upper rail and projecting from a side of the upper rail opposed to the panels.

6. A method for erecting a partition wall structure in a vertical plane in a room having a ceiling, a floor and lateral walls, said partition wall structure comprising a grooved upper rail, a tongued lower rail, a grooved upright and generally rectangular panels each having two adjacent edges comprising a torque extending along each of the edges and two adjacent edges comprising a groove extending along each of the edges, said method comprising fixing the upright to one of the lateral walls of the room, placing on the floor the lower rail so that it fits in the groove of the upright, fitting a first panel in the groove of the upright and fitting a groove of the first panel on the tongue of the lower rail, fitting a second panel against the first panel and against the lower rail so that a groove of the second panel fits on a tongue of the first panel and a groove of the second panel fits on the tongue of the lower rail, and so on until the required length of the partition wall structure is obtained, thereafter placing other panels directly on the top of the preceding panels with interlocking of the tongues and grooves of the panels and the engagement of the panels adjoining the upright in the groove of the upright, the panels forming therebetween vertical joints which are arranged so that the vertical are in staggered relation to one another, thereafter placing directly on the uppermost panels the upper rail so that the groove of the upper rail fits on the tongues of the last panels and thereafter exerting a downward pressure on the upper rail so as to vertically forcefully clamp together the upper rail, the interposed panels and the lower rail by expanding expansible means carried by the upper rail between the upper rail and the ceiling and leaving the expansible means in position.

7. The combination of a room having a floor, ceiling and lateral walls and a partition wall structure which is capable of being dismantled, the partiton wall structure comprising in combination an outer framework comprising a horizontal lower rail placed on said floor, a horizontal upper rail located adjacent said ceiling and a vertical upright placed against and secured to one of said walls; an assembly in a vertical plane of adjoining generally rectangular panels located within the framework and adjoining the upper rail and the lower rail and adjoining the upright, there being a plurality of the panels in vertically adjoining relation to each other between the upper rail and lower rail and a plurality of panels in adjacently adjoining relation to each other, the panels forming therebetween vertical joints which are in laterally staggered relation to each other from one joint to the next higher or lower joint, each panel defining four edges, means defining tongues and grooves which are unitary with the edges of the panel before assembly in said assembly of panels and respectively fitting with corresponding grooves and tongues of adjoining panels in said assembly to interlock the panels perpendicularly of said plane; means interlocking perpendicularly of said plane the upper rail and lower rail with the adjoining panels of said panels; and means interlocking perpendicularly of said plane the upright with the adjoining panels of said panels, the upper rail being vertically moveable in said framework relative to the upright; the panels being held together to form a wall structure which is coherent and resistant with regard to forces perpendicular to said plane by means consisting of said interlocking tongues and grooves of the panels and of pressure-applying expansible means which apply vertically downward pressure on the upper rail and thereby vertically clamp the panels against one another and against the lower rail, the pressure-applying expansible means being interposed between and bearing against the upper rail and the said ceiling.

8. The combination claimed in claim 7, wherein said pressure-applying expansible means comprise screw jacks interposed between the upper rail and the ceiling and the lower rail is substantially solid and has a substantially rectangular cross-sectional shape and a lower side which bears against the floor substantially throughout the extent of said lower side transversely of said plane.

* * * * *